US005095555A

United States Patent [19]

Torii et al.

[11] Patent Number: 5,095,555

[45] Date of Patent: Mar. 17, 1992

[54] TOILET SEAT STRUCTURE HAVING HEATER AND THERMO-SENSOR WIRES

[75] Inventors: Yoshiyuki Torii, Hekinan; Yuji Yamaguchi, Anjo; Shinji Kawai, Toyota; Kenichi Kaneko, Kariya, all of Japan

[73] Assignee: Aisin Seiki Kabushiki Kaisha, Kariya, Japan

[21] Appl. No.: 528,475

[22] Filed: May 25, 1990

[30] Foreign Application Priority Data

Jun. 1, 1989 [JP] Japan ..... 1-64152[U]

[51] Int. Cl.[5] ..... A47K 13/30

[52] U.S. Cl. ..... 4/237; 4/DIG. 6; 219/217; 174/115

[58] Field of Search ..... 4/237, DIG. 6; 174/115; 219/217

[56] References Cited

U.S. PATENT DOCUMENTS

| | | | |
|---|---|---|---|
| 1,058,270 | 4/1913 | Stephens | 4/DIG. 6 X |
| 1,297,031 | 3/1919 | Stable | 4/DIG. 6 X |
| 2,518,789 | 8/1950 | Jackson | 174/115 |
| 2,798,142 | 7/1957 | Mancin | 219/217 |
| 3,023,267 | 2/1962 | Rubinstein et al. | 174/115 |
| 3,493,721 | 2/1970 | Kamitani et al. | 219/217 |
| 3,715,458 | 2/1973 | Bayes et al. | 174/115 |
| 3,760,147 | 9/1973 | Tyrey | 219/217 |
| 4,446,584 | 5/1984 | Suzuki et al. | 4/237 |
| 4,798,936 | 1/1989 | Johnson, Sr. | 219/217 |
| 4,937,401 | 6/1990 | Lee | 174/115 X |

FOREIGN PATENT DOCUMENTS

| | | | |
|---|---|---|---|
| 0360567 | 6/1938 | Italy | 219/217 |

*Primary Examiner*—Henry J. Recla
*Assistant Examiner*—Casey Jacyna
*Attorney, Agent, or Firm*—Oblon, Spivak, McClelland, Maier & Neustadt

[57] ABSTRACT

A toilet seat has a heater connected to a controller for supplying heating current thereto via a first cable. A thermo-sensor in the toilet seat provides temperature signals to the controller via a second cable. The controller terminates the current to the heater upon the termination of signals from the thermo-sensor. The wires of the second cable have a diameter larger than those of the first cable, so that the wires of the second cable, which provide the temperature signal to the controller, will fail due to bending stresses upon repeated raising and lowering of the toilet seat, before the wires of the first cable. This will cause the controller to terminate the supply of current to the heater.

6 Claims, 4 Drawing Sheets

TOILET SEAT STRUCTURE HAVING HEATER AND THERMO-SENSOR WIRES

BACKGROUND OF THE INVENTION

1. Field of the Invention

The present invention relates to a toilet seat structure and in particular to a toilet seat structure in which a seat is warmed up to a desired temperature.

2. Description of the Related Art

In general, a seat is pivoted to a casing which is secured on a rear end portion of an upper surface of a toilet bowl. The seat may be warmed up to a desired temperature by a heater provided at an inner surface thereof. A thermo-sensor is also provided on the inner surface of the seat, for detecting the current actual temperature thereof. The heater and the thermo-sensor are connected to a controller accommodated in the casing via a first cable and a second cable, respectively, both of which extend from the casing to the inner surface of the seat. A cross-sectional area of each wire of the first cable is larger than that of each wire of the second cable due to the fact that more current flows in the former. Thus, the first cable may be broken or cut due to unexpected reasons.

If the break in the cable is complete, then no current will reach the seat. On the other hand, the wires of the cable may be only partially broken. The reduced cross section of the cable in the region of the break can cause overheating of the cable, which can melt the surrounding insulator and poses a fire hazard. Moreover, even in the case of a complete break of the cable wires, the surrounding insulation can hold the two broken ends of the wires in sufficient contact that current transmission, with excessive heating in the region of the break, can occur.

SUMMARY OF THE INVENTION

It is therefore a primary object of the present invention to provide a toilet seat structure without the aforementioned drawback.

The above, and other, objects are accomplished according to the present invention by a toilet seat structure including a toilet bowl, a casing mounted on the toiled bowl, a seat pivoted on the casing so as to be moved up and down by an angle, a heater provided at an inner surface of the seat, a thermo-sensor provided at the inner surface of the seat in order to detect the temperature of the seat, and a controller accommodated within the casing. A first cable connected between the controller and the heater comprises wires for supplying current to the heater, while a second cable has wires with a larger diameter than those of the first cable and is connected for providing signals from the thermo-sensor to the controller. As a result, the wires of the second cable fail before those of the first cable.

BRIEF DESCRIPTION OF THE DRAWINGS

The above and other objects, features and advantages of the present invention will become more apparent and more readily appreciated from the following detailed description of preferred exemplary embodiments of the present invention, taken in connection with the accompanying drawings, in which.

DETAILED DESCRIPTION OF THE PREFERRED EMBODIMENTS

Figure 1:
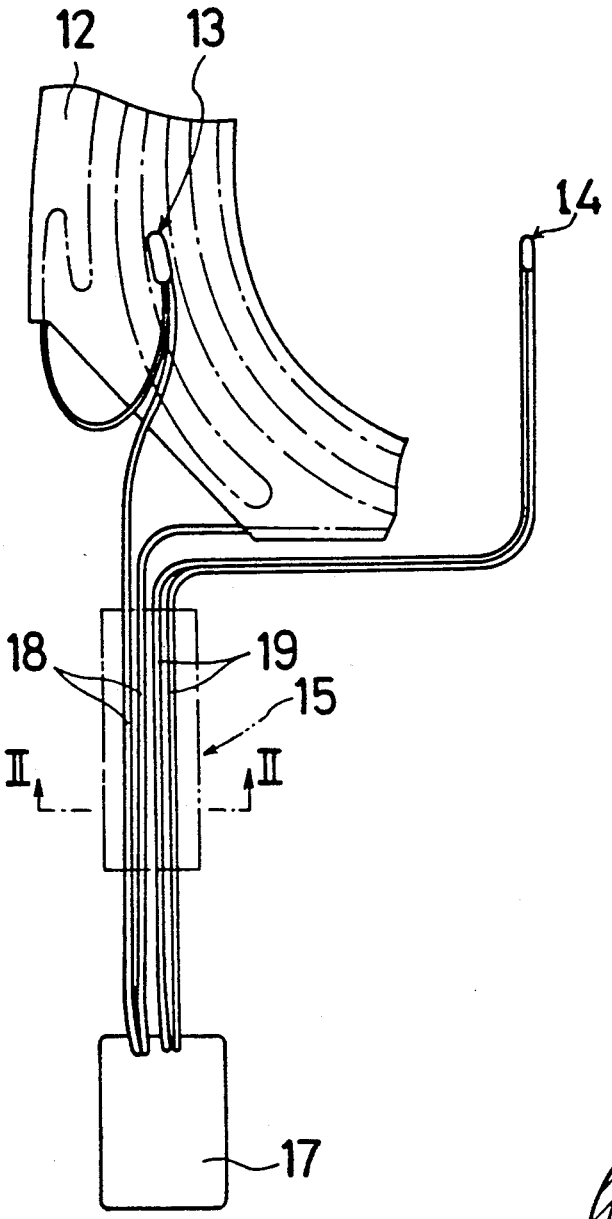
FIG. 1 is a schematic plan view showing a cable-connection according to the invention.

Referring to FIGS. 1 through 5, a toilet seat structure includes a seat 11 which is pivotably connected with a casing 16 by pivot pins 22. The casing 16 is fixedly connected to a rear portion of an upper periphery of a toilet bowl 10 which is installed on a floor F in a well-known manner. On an inner surface of the seat 11, there are provided a heater 12 and a thermo-sensor 14 which are connected, via a first cable 18 and a second cable 19 respectively, to a controller 17. Both cables 18 and 19 pass through a cabtyre cable 15. The controller 17 is accommodated within the casing 16 and is connected, via a cord or wire 20, to a power supply which is commercially available. A portion 15*a* of the wire 15 is deformed, upon upward movement of the seat 11, into an arc with a progressively smaller radius as the seat 11 is raised due to its passage around the pin 22.

As seen in FIG. 1, although both cables 18 and 19 are shown as being arranged in parallel for easy understanding, they are actually twisted about one another for reasons of enforcement thereof. The controller 17 has means for stopping the current to the heater 12 upon interruption of a signal from the thermo-sensor 14 to the controller 17. For example, the controller 17 may include a microprocessor programmed to terminate current to the heater upon failure to detect a signal from the sensor 14.

An additional sensor 13 is provided on the inner surface of the seat 21 and is connected to the controller 17. The additional sensor 13 is in the form of a thermal-fuse, is similar to the thermal-sensor 14 and provides the function of the sensor 14 upon the malfunction of the sensor 14. The additional sensor 13 generally acts as a means for preventing excess heating of the heater 12. Although not illustrated in FIG. 2, it also has wires passing through cable 15.

Figure 2:
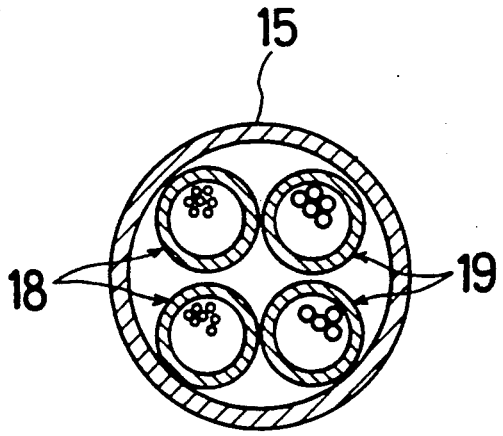
FIG. 2 is a cross-sectional view taken along line II—II in FIG. 1.
Figure 3:
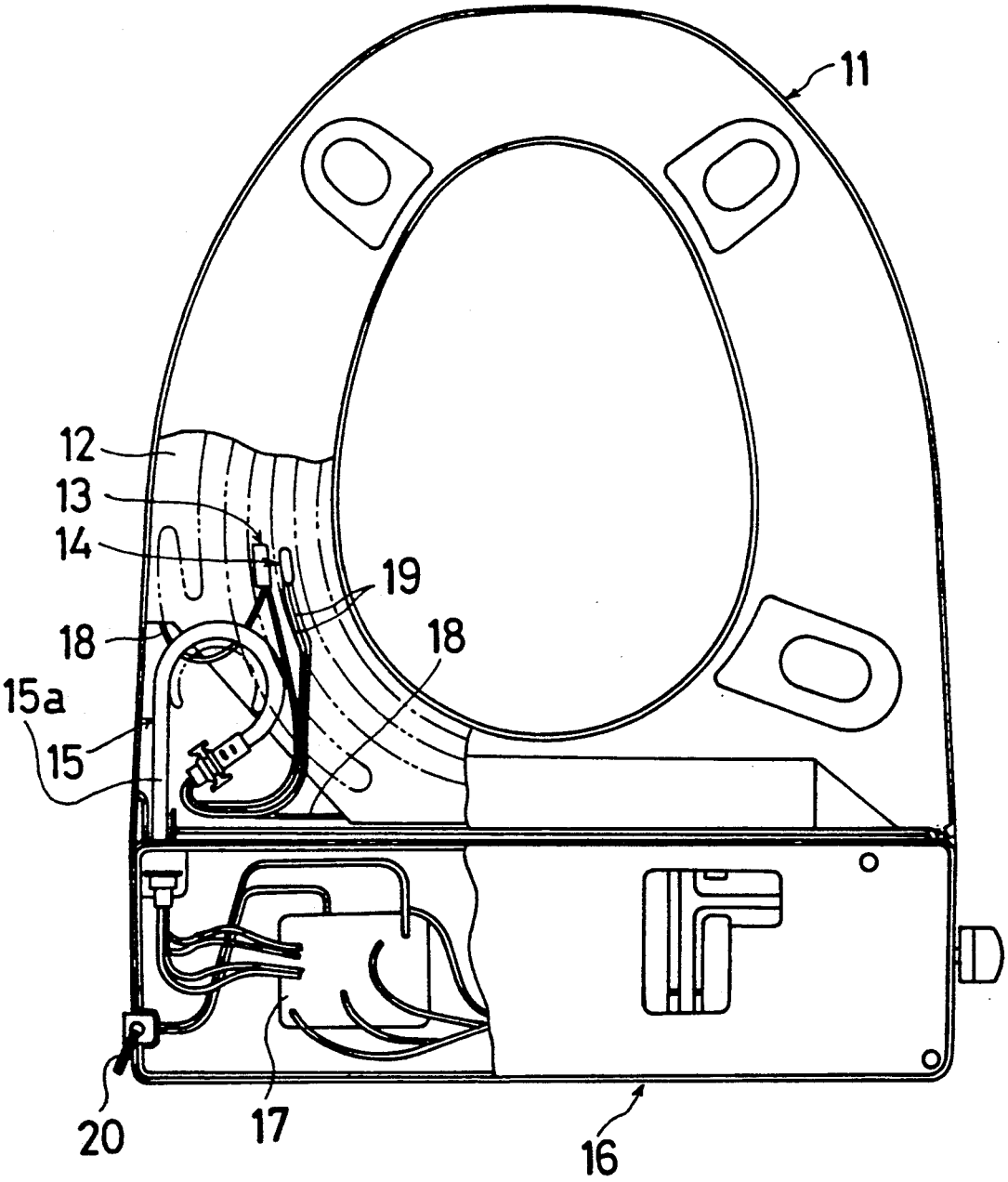
FIG. 3 is a rear side view of a seat structure with the seat raised.
Figure 4:
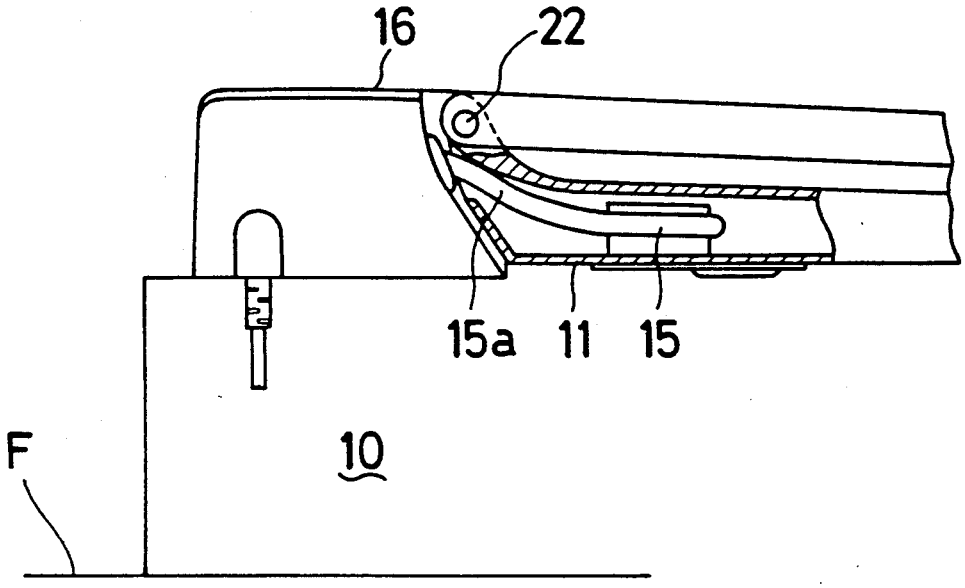
FIG. 4 shows a lowered condition of the seat.
Figure 5:
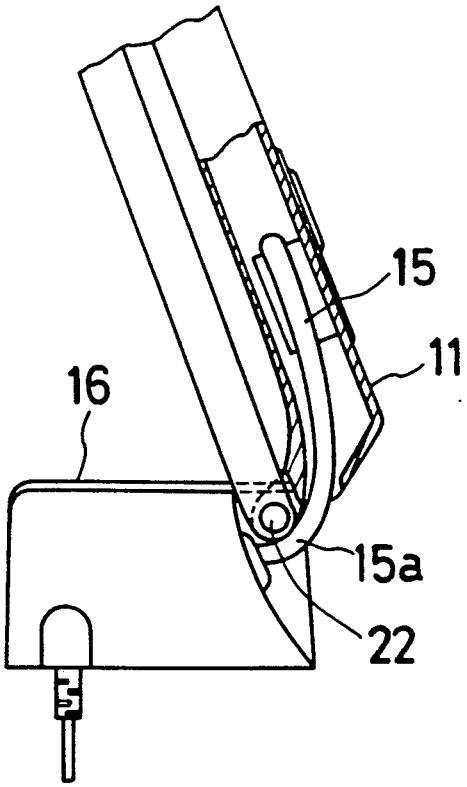
FIG. 5 shows a raised condition of the seat.

As shown in FIG. 2, cross-sections of both cables 18 and 19 are illustrated. Individual wires of the cable 19 are larger than those of the cable 18 in diameter. For example, the cable 18 is obtained by twining 149 wires, each of which is 0.08 mm in diameter. On the other hand, the cable 19 is obtained by twining 30 wires, each of which is 0.18 mm in diameter. The number of wires in each cable is selected such that the sectional area of the wires in each cable 18 or 19 is 0.75 mm square. Each cable 18 of 19 is made of a material with excellent conductivity such as a copper.

In light of the fact that the degree of deformation of each wire at 15*a* during bending increases in proportion to the increase of its radius or diameter, the cable 19 is less resistant than is the cable 18 to failure due to repeated deformation. Therefore, the fatigue of each cable 18 or 19 owing to repeated pivotal movement or extremely frequent pivotal movement of the seat 11 results in the cable 19 consistently breaking prior to the cable 18.

Figure 6:
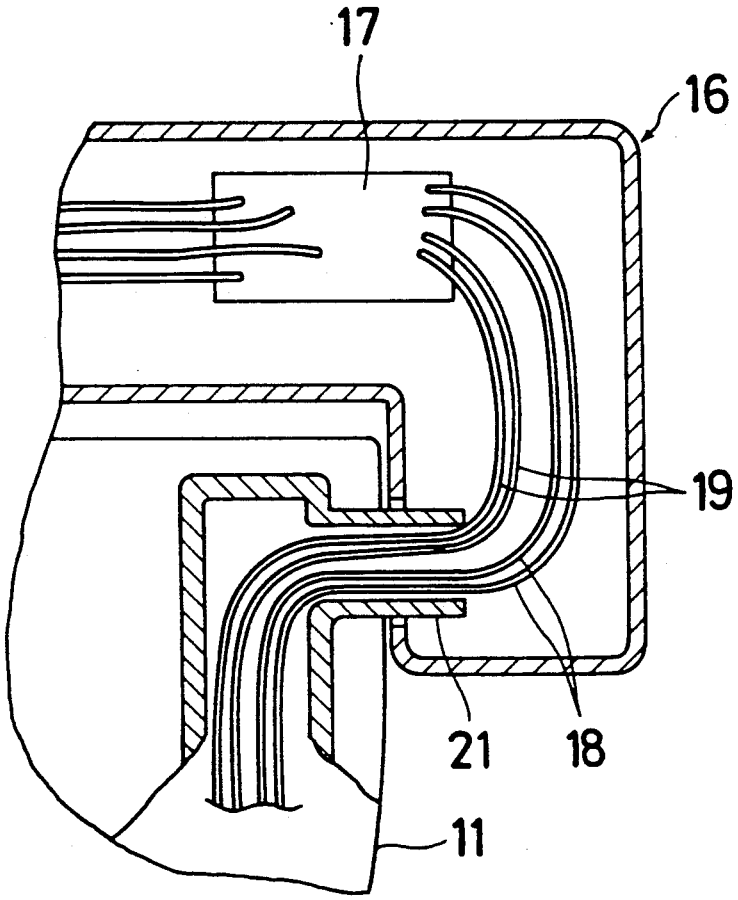
FIG. 6 corresponds to FIG. 1, but shows another seat structure according to the invention.

As shown in FIG. 6, cables 18 and 19 may pass through a boss 21 which is employed instead of the pins 22. Under this construction, wire failure similar to the foregoing will occur, except that twisting forces are applied to cables 18 and 19.

As mentioned above, according to the present invention, before the breaking of the cable for supplying current to the heater, the breaking of the cable for transmitting signal to the controller surely occurs. The resulting interruption of a signal to the controller 17 causes it to shut off the current to the heater 12. Thus, excess heating, which could otherwise occur in the region of a break in the cable 18, is prevented.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A toilet seat structure comprising:

a toilet bowl;

a casing mounted on the toilet bowl;

a seat pivoted on the casing so as to be moved up and down by an angle;

a heater provided at an inner surface of the seat;

a thermo-sensor provided at the inner surface of the seat in order to detect the temperature of the seat;

a controller accommodated within the casing;

a first cable connected between said controller and said heater and comprising wires for supplying current to the heater; and a second cable having wires with a larger diameter in comparison with those of the first cable and connected for providing signals from the thermo-sensor to the controller, whereby said wires of said second cable fail before said wires of said first cable due to bending of the cables as the seat is moved up and down.

2. A toilet seat structure according to claim 1, wherein said controller includes means for terminating current to said heater when said controller stops receiving a flow of said signals from said thermo-sensor.

3. A toilet seat structure according to claim 2, wherein a cross-sectional area of the wires of said first cable is equal to that of the wires of said second cable.

4. A toilet seat structure according to claim 2, wherein said cables are together curved into a substantial circle in the seat.

5. A toilet seat structure according to claim 2, further comprising a pivot pin for pivotably connecting the casing and the seat, said cables passing by said pivot pin such that said cables are bent around said pivot pin when said seat is raised.

6. A toilet seat structure according to claim 2, wherein said cables are exposed between said casing and said seat.

* * * * *